US006370989B1

(12) United States Patent
Baker

(10) Patent No.: US 6,370,989 B1
(45) Date of Patent: Apr. 16, 2002

(54) ADJUSTABLE WRENCH

(75) Inventor: David R. Baker, Fort Worth, TX (US)

(73) Assignee: David Baker, Inc., Fort Worth, TX (US)

( * ) Notice: Subject to any disclaimer, the term of this patent is extended or adjusted under 35 U.S.C. 154(b) by 0 days.

(21) Appl. No.: 09/634,971

(22) Filed: Aug. 9, 2000

Related U.S. Application Data

(60) Provisional application No. 60/148,982, filed on Aug. 13, 1999.

(51) Int. Cl.[7] ..... B25B 13/16
(52) U.S. Cl. ..... 81/170; 81/186
(58) Field of Search ..... 81/165, 166, 170, 81/186, 418, 424.5, 119

(56) References Cited

U.S. PATENT DOCUMENTS

| | | | | |
|---|---|---|---|---|
| 3,955,450 A | | 5/1976 | Evans | |
| 4,472,986 A | | 9/1984 | Gottlieb | |
| 4,548,104 A | | 10/1985 | Hendricks | |
| 4,735,121 A | | 4/1988 | Coulson | |
| 4,753,141 A | | 6/1988 | Hamrick et al. | |
| 4,889,020 A | | 12/1989 | Baker | |
| 5,022,290 A | | 6/1991 | Duffy | |
| 5,048,380 A | | 9/1991 | Caldwell | |
| 5,209,144 A | | 5/1993 | Lu Guoji | |
| 5,222,419 A | | 6/1993 | Spector | |
| 5,239,898 A | | 8/1993 | Douglas | |
| 5,239,899 A | | 8/1993 | Baker | |
| 5,249,490 A | | 10/1993 | Kennel | |
| 5,301,576 A | | 4/1994 | Nye | |
| 5,305,667 A | | 4/1994 | Caballero | |
| 5,377,566 A | | 1/1995 | Mandigo | |
| 5,381,710 A | | 1/1995 | Baker | |
| 5,551,322 A | | 9/1996 | Mikic et al. | |
| 5,806,383 A | * | 9/1998 | Hsieh | 81/170 |
| 5,878,636 A | | 3/1999 | Baker | |
| 5,884,539 A | | 3/1999 | Baker | |
| 5,896,790 A | | 4/1999 | Chiang | |
| 6,029,548 A | | 2/2000 | Hsieh | |
| 6,098,501 A | * | 8/2000 | Sundstrom | 81/119 |

* cited by examiner

*Primary Examiner*—D. S. Meislin
(74) *Attorney, Agent, or Firm*—Bracewell & Patterson, L.L.P.

(57) ABSTRACT

An adjustable wrench for driving a nut utilizes curved drive faces. The wrench is made up of three members. A first member has a jaw section, a mid section and a handle section. A second member has a jaw section and an attachment section for attaching to the first member in the mid section and adjusting the spacing of the jaws. A third member fits within the first member and attaches the first member to the second member in an adjustable manner in the mid section of the first member. The jaws of the first and second members have convex curved surfaces having forward and rearward drive faces. These convex curved surfaces form gripping members which drive the nut or bolt on the planes and not on the corners.

6 Claims, 6 Drawing Sheets

ADJUSTABLE WRENCH

CROSS REFERENCE TO RELATED APPLICATION

This application claims the benefit of priority of U.S. Provisional Application, Ser. No. 60/148,982 which was filed on Aug. 13, 1999.

TECHNICAL FIELD

This invention relates in general to adjustable wrenches and in particular, to an adjustable wrench having multiple arched gripping members on the drive faces of the jaws of the adjustable wrench.

BACKGROUND OF THE INVENTION

Often the work environment for a user of an adjustable wrench is a small space and therefore requires multiple cycles of placing the wrench on the nut, turning a small angle, removing the wrench and readjusting. Usually, a worm gear-rack mechanism in the head structure of the wrench is disposed in driving relation with gear teeth that are provided on the movable jaw. While the main advantage of an adjustable jaw wrench is the ability to rotate variable size bolts or nuts, some of the disadvantages involve the tradeoff between a tight fit of the wrench faces to the nut flats versus having too wide a separation of faces in which case the wrench faces slip off the nut as torque is applied. Additionally, when a great amount of torque is applied, the adjustable jaw tends to back off the object being gripped. Often, for both of these cases the nut is damaged as a result of rounding of the corners and the user may be injured.

Several solutions to increase the torque that may be applied to the nut or bolt are discussed within. One group of solutions focus on providing a greater wrench face resistance to adjustment once a setting has been set on an adjustable face. For example, by placing a spring between the worm gear and a side of the slot opposite the fixed jaw of the wrench, the natural tension within the spring will provide a force to maintain the adjustable jaw in the correct position. Another approach has included providing a locking means, such as a nut threaded on to the exterior of the wrench in order to lock the position of the adjustable jaw once adjustment has been made.

Another group of solutions has focused on increasing the surface contact of the wrench face to the nut or bolt. For example, U.S. Pat. No. 5,239,899 for a Wrench with Inclined Drive Faces teaches a single main drive face 55 shown on each jaw and having a single notch on each drive face for retaining a nut.

For the foregoing reasons there exists a need for an adjustable wrench that has an increased surface area on the jaws for gripping the nut or bolt. There is a need for an adjustable wrench that has a high angle of approach. There is also a need for an adjustable wrench that locks on the nut under torque and that drives on the nut planes when the jaw is tight or loose. For the foregoing reasons there exists a need for an adjustable wrench that is safer for the user and protects the nut corners from rounding.

SUMMARY OF THE INVENTION

In this invention an adjustable wrench has a handle with a stationary member and a movable member on a front end of the handle. The stationary member and the movable member define an opening for engaging a nut. The opening is defined by a stationary jaw face on the upper or stationary member and a movable jaw drive face on the lower or movable member. On each of the stationary drive face and the movable drive face are a plurality of arc planes, usually four, that function together as gripping members that are provided to assist in gripping the flats of a nut.

The gripping members are preferably arched in cross-section and run across the width of the jaw drive face, although gripping members that traverse a portion of the width of the jaw drive face could be used. The gripping members may be of equal size or possess a progressive pitch wherein the size of each gripping member progressively decreases from a front edge to a rear edge or vice versa. It is understood that certain wrench sizes are meant for driving a certain range of nut or bolt sizes. Pitch sizes for gripping members can be selected that will maximize that amount of surface area driving on the nut that are appropriate for the size wrench desired. Similarly, the gripping members may either be symmetrical or asymmetrical wherein a forward or rearward portion of an individual gripping member has a different curvature than the remainder of the gripping member. Other variations for the gripping members include a two radius bias or a three radius bias for the cross-section of each individual gripping member.

DETAILED DESCRIPTION OF THE INVENTION

Figure 1:
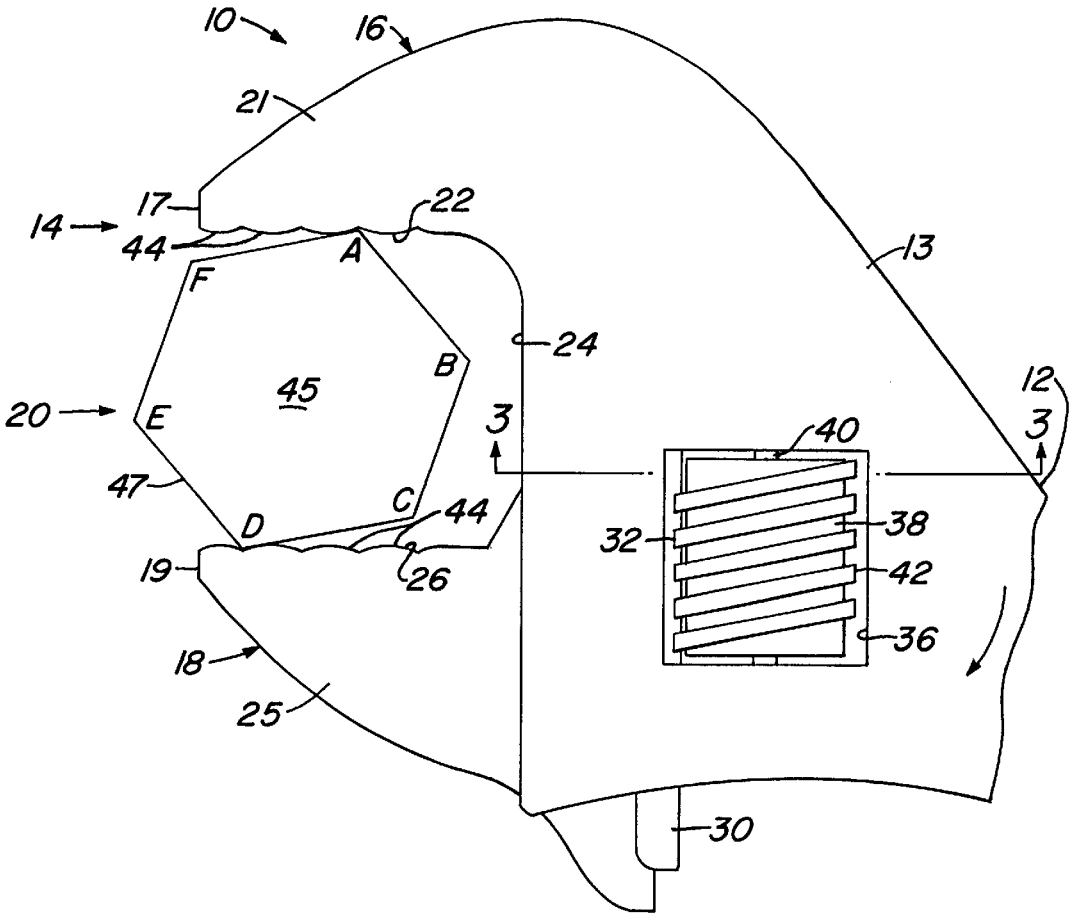
FIG. 1 is an elevational view of an adjustable wrench of the invention shown driving a nut in a clockwise direction.

Referring now to FIGS. 1–5, shown is an adjustable wrench 10. Adjustable wrench 10 has a handle 12 with a front end 14. On the front end 14 is a stationary member 16 and a movable member 18. Stationary member 16 has a nose 17 on its forward end, and the movable member 18 has a nose 19 on its forward end. The stationary member 16 and movable member 18 define an opening 20. More particularly, the opening 20 is defined by a jaw section 21 that has a downwardly facing stationary jaw drive face 22, a web portion 24 on handle 12 and a jaw section 25 that has an upwardly facing movable jaw drive face 26. The wrench 10 is usually made from tool grade materials, typically metal. Note that the details of construction and operation of wrench jaws are well known and described here as background.

Figure 2:
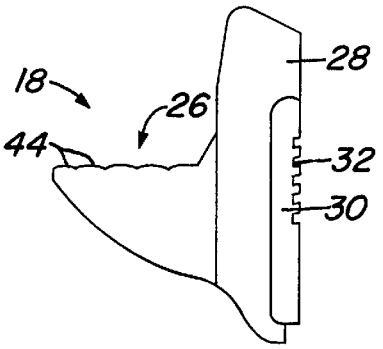
FIG. 2 is an elevational view of a movable member shown in FIG. 1.
Figure 3:
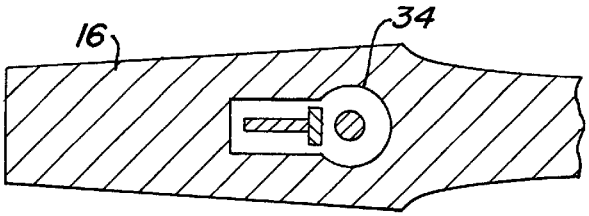
FIG. 3 is a cross sectional view through the barrel and mid section along the plane of the line 3—3 in FIG. 1.

Referring to FIG. 2, the movable member 18 is shown in greater detail apart from the wrench 10. The jaw section 25 of the member 18 has an upwardly facing movable jaw drive face 26 that extends forward from a shank 28 or web portion 24 and a barrel 30 having a plurality of notches 32 therein. Barrel 32 is received within an attachment or barrel portion 34 formed in a mid section 13 of stationary member 16 and visible in cross-section in FIG. 3. Material is removed from mid section 13 to form a hollow space for receiving the barrel 32. The barrel 32 is movable upwardly and downwardly within barrel portion 34 of stationary member 16 to move moveable member 18 into position to grasp objects within opening 20 with movable jaw drive face 26.

Referring back to FIG. 1, a cavity 36 is provided on stationary member 16 that receives a cylindrical worm gear 38. Cylindrical worm gear 38 is rotatably mounted on a rod 40. Cylindrical worm gear 38 has protruding threads 42 thereon for engaging notches 32 in the barrel 30 of moveable member 18 and for driving movable member 18 upwardly and downwardly within barrel portion 34. Although a wrench having standard worm gear action is shown as an example, it should be understood that the invention may be utilized on other types of wrenches or tools. As can be seen in FIG. 1 and FIG. 2, the movable jaw drive face 26 and the stationary jaw drive face 22 have a plurality of gripping members 44 located thereon.

Figure 4:
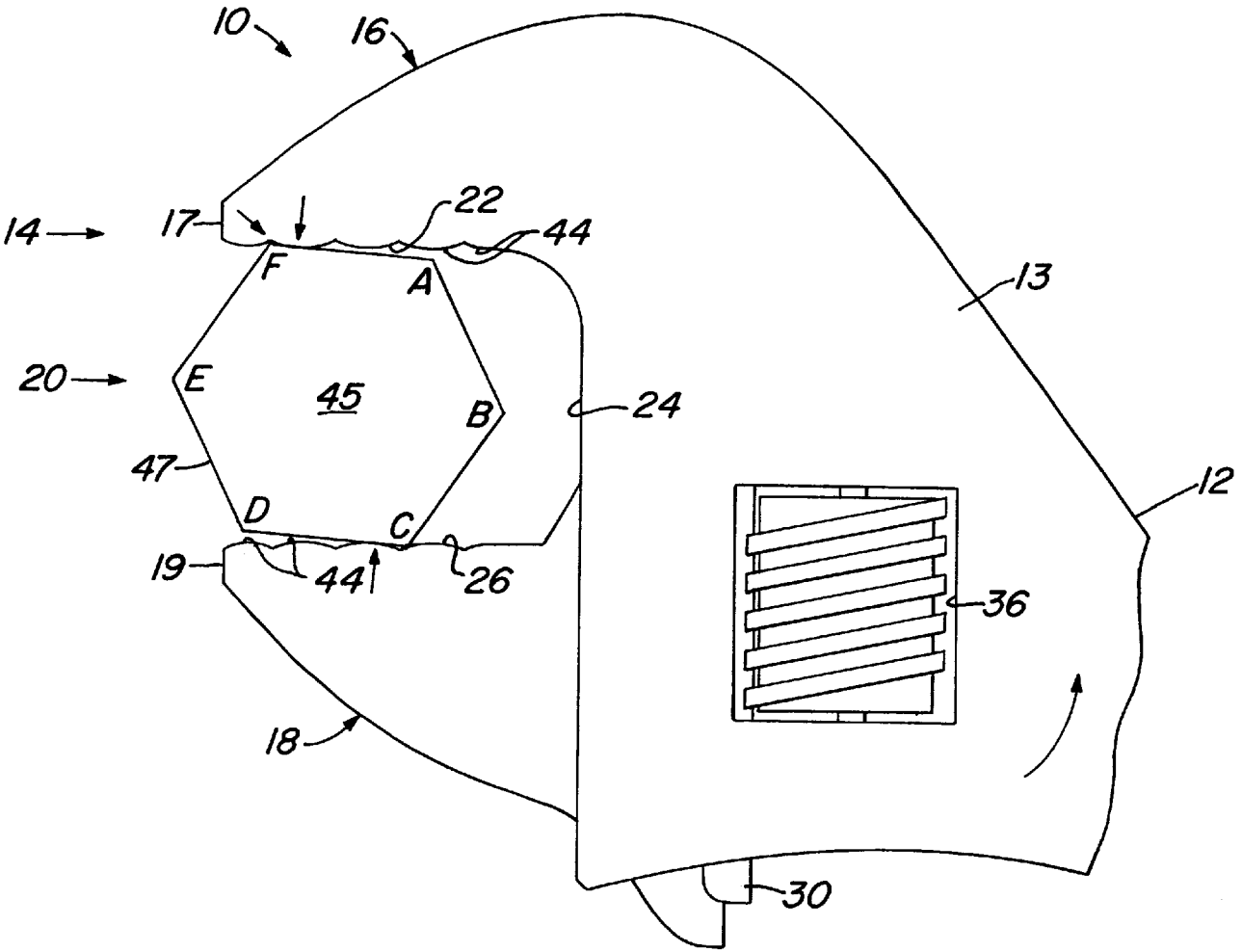
FIG. 4 is an elevational view showing the adjustable wrench of FIG. 1, engaging a nut while driving a nut in a counterclockwise direction.
Figure 5:
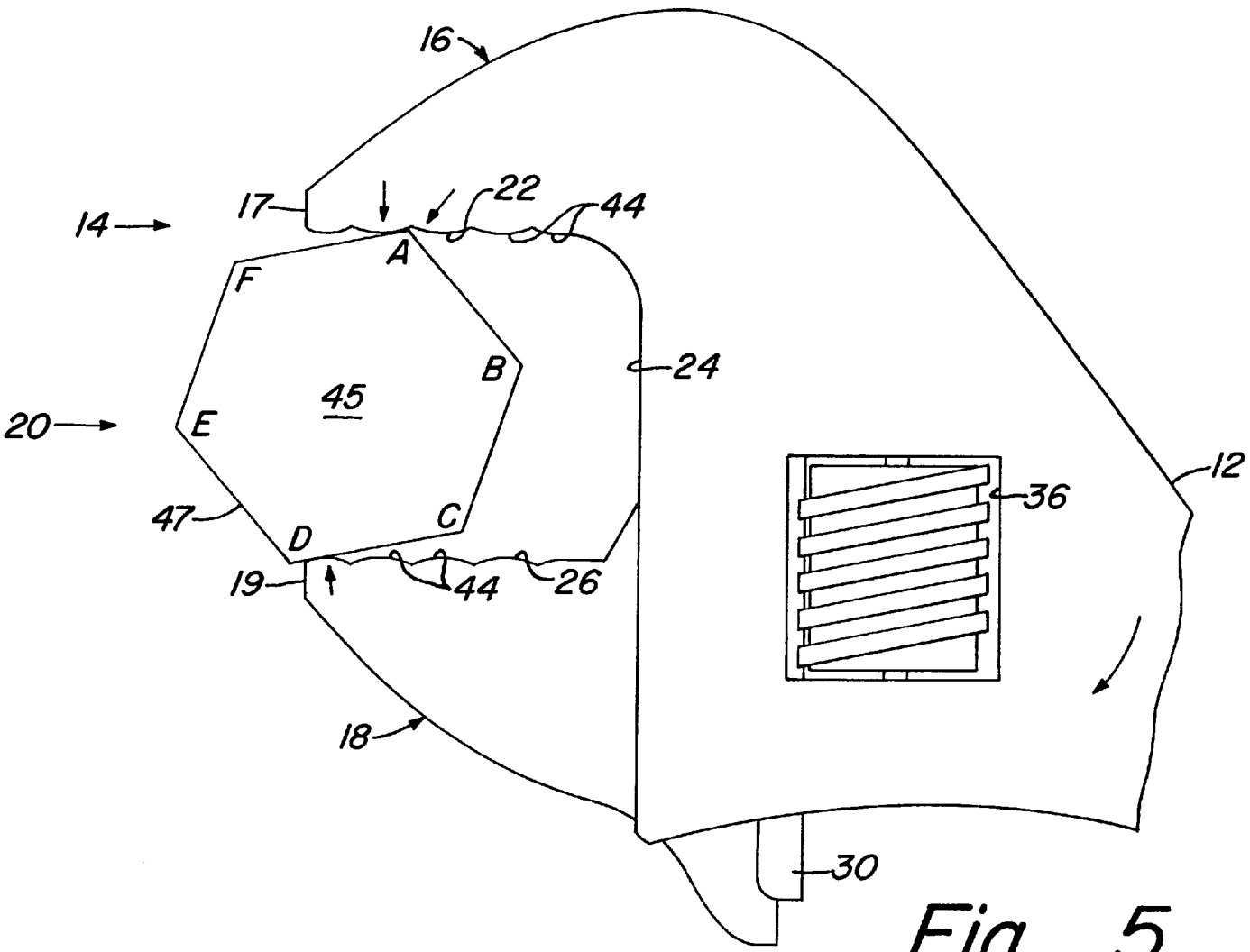
FIG. 5 is an elevational view of the adjustable wrench shown in FIG. 1, showing the wrench engaging a nut in nose drive engagement.

Referring to FIGS. 1, 4 and 5, a nut 45 is shown being grasped by wrench 10. Nut 45 has six corners A, B, C, D, E and F. Nut 45 also has six sides or flats 47, located between the corners.

Figure 6:
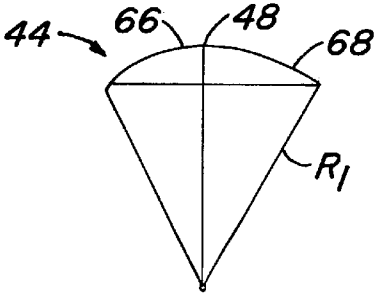
FIG. 6 is a schematic side view of the profile of one of the gripping member of the wrench of FIG. 1, showing a one radius bias.
Figure 7:
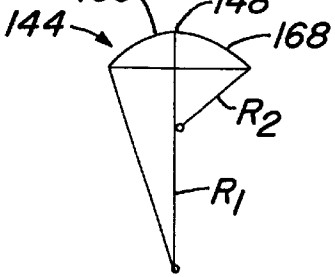
FIG. 7 is a schematic side view of the profile of an alternate gripping member having a two radius bias.

Each gripping member 44 is made up of a series of arc planes 66, 68 that are separated by a fillet 64 shown in greater detail in FIGS. 6–12. When the jaws are in a closed position, nose 17 abuts nose 19, a nose plane is defined by a line tangent to each gripping member 44. Referring now to FIGS. 6–12, gripping members 44 are shown in their various embodiments. FIG. 6 shows an enlargement of a gripping member 44, wherein a cross-section of a driving surface 66, 68 of gripping member 44 has a single radius of curvature $R_1$ with an apex 48 at its center. FIG. 7 shows an alternative gripping member 144, wherein a cross-section of the driving surface 166, 168 of gripping member 144 reveals a driving surface 166, 168 having a curvature defined by two radiuses, $R_1$, $R_2$, or having a two radius bias. Radius $R_2$ is smaller than radius $R_1$. The rearward portion of driving surface 166, 168 is at radius $R_2$. The two radii bias has a greater surface contact with the nut face than the one radius bias. This promotes better forward drive.

Preferred locations of the apex 148 of gripping members 144 may be ⅔ to ¾ from either end of fillet 64. However, other configurations of the driving surface 166, 168 of gripping member 144 may be used. When the apex 48 of the driving surface 166, 168 of gripping members 144 is not centered, one portion, i.e. the forward or rearward portion, of driving surface 166,168 of gripping member 144 will have a steeper slope than the other portion.

Figure 8:
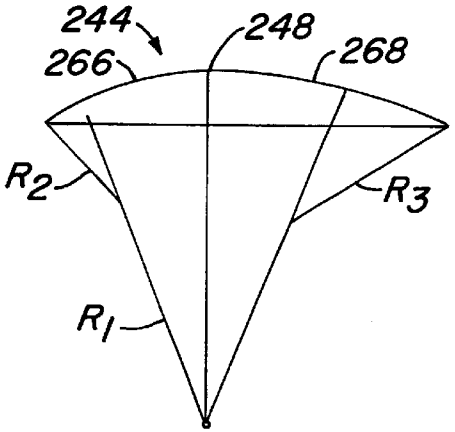
FIG. 8 is a schematic side view of the profile of another alternate gripping member showing a three radius bias.

Referring now to FIG. 8, an additional embodiment of gripping member 244 is shown. FIG. 8 shows a gripping member 244, wherein the cross-section reveals a driving surface 266, 268 having curvature defined by three different radiuses, $R_1$, $R_2$ $R_3$, or having a three radius bias. Apex 248 is centered.

Figure 9:
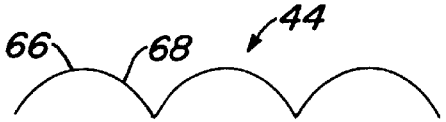
FIG. 9 is a schematic side view of the profiles of a plurality of gripping members of the wrench of FIG. 1, showing equal pitch.
Figure 10:
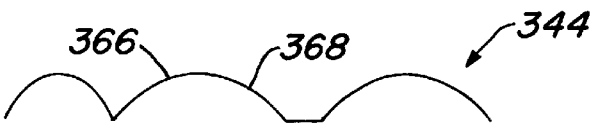
FIG. 10 is a schematic side view of the profile of a plurality of another embodiment of gripping members that vary in both pitch and depth.
Figure 11:
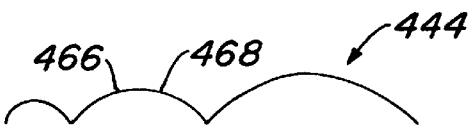
FIG. 11 is a schematic side view of the profile of a plurality of alternate gripping members with a progressive pitch.

The gripping members 44 formed on the drive face 22 or 26 may each be of equal size, as is shown in FIG. 9. Alternatively, as shown in FIG. 10, the pitch, or distance from a forward end to a rearward end of a gripping members 344 may vary. For example, the gripping members 344 may have a smaller pitch towards the forward end of the jaw drive face 22 or 26 (see FIG. 1) and each gripping member may progressively have a larger pitch towards the end of the jaw drive face 22 or 26 nearest web 24. Alternatively, the gripping members 344 may progressively vary from a large pitch on a forward end of the drive face 22 or 26 and progressively decrease to a smaller pitch at the end of the drive face 22 or 26 nearest the web 24.

Further, the gripping members 44 may vary in depth, wherein the gripping members nearest the forward end of the jaw drive face 22 or 26 have a greater depth and the gripping members 44 at the end of the jaw drive face 22 or 26 nearest the web 24 are shorter or have a shallower depth. The gripping members 44 may also vary from shallow depth near the forward end of the jaw drive face 22 or 26 to a having a greater depth towards the end of the jaw drive face 22 or 26 nearest web 24. Further, the gripping members may vary in both pitch and depth as shown by gripping member 444 and driving surfaces 466,468 in FIG. 11. A preferred size of a gripping member is a pitch of 12.5 to a height of 1.

Figure 12:
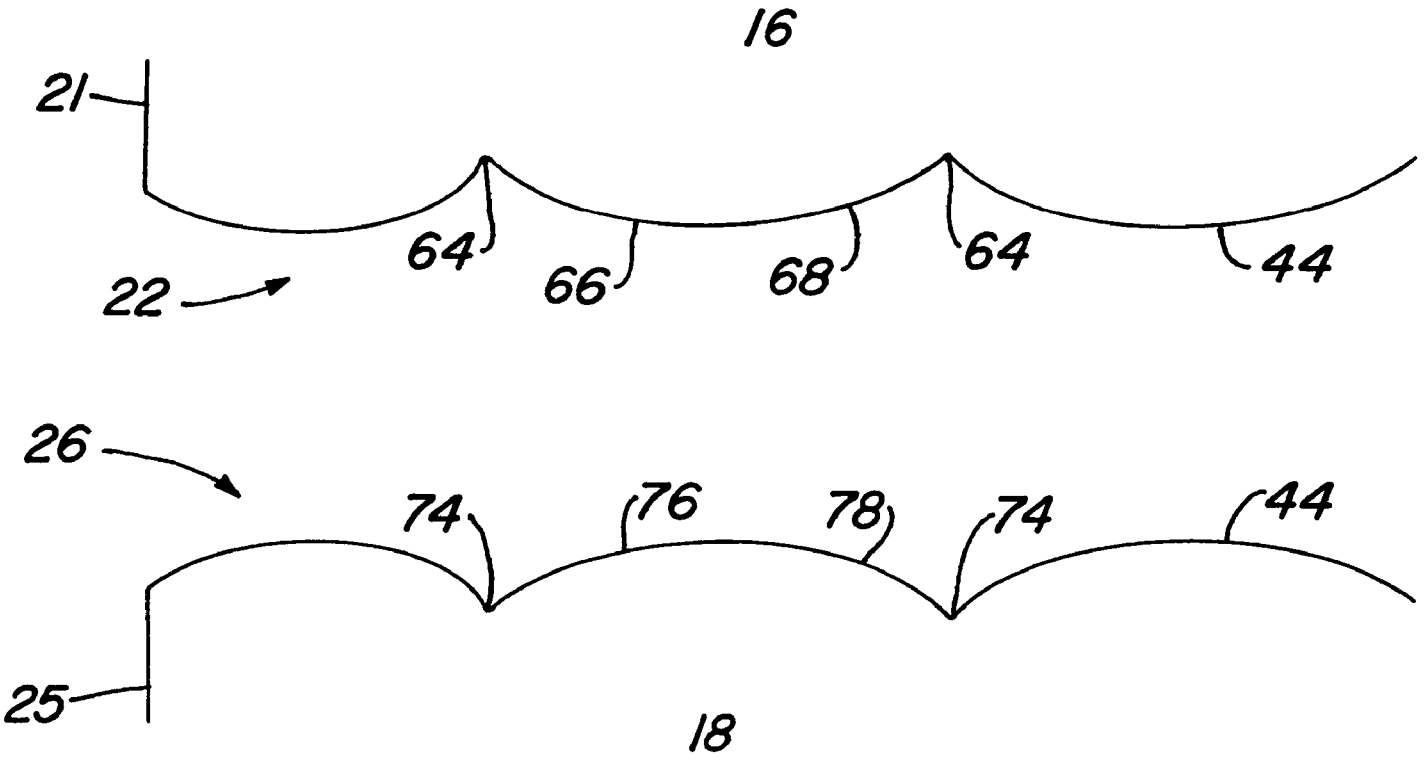
FIG. 12 is a further enlarged side elevational view of the stationary jaw and movable jaw of the wrench of FIG. 1.

FIG. 12 shows opposing gripping members 44 from the stationary member 16 and moveable member 18. Gripping member 44 on the stationary jaw drive face 22 is made of arc planes 66, 68 which includes a forward jaw face 66 and a rearward jaw face 68. Forward jaw face 66 faces forward and downward while rearward jaw face 68 faces rearward and downward. Each of the arc planes consists of one or more arcs, each having a separate radius of curvature. These series of arc planes 66, 68 function together as gripping members 44, with each arc plane being a convex curved driving surface. Each gripping member 44 is separated by a fillet 64 on each jaw face. The movable jaw drive face 25 also has arc planes 76, 78 which includes a forward jaw face 76 and a rearward jaw face 78. Arc planes 76, 78 also function as a gripping member 44. A similar ratio of forward jaw face 76 length to rearward jaw face 78 length as the stationary jaw drive face 22 is used in designing the movable jaw drive face 26, only the ratio is reversed for practical purposes. Each gripping member 44 has a length much greater than its depth. Preferably the length is more than three times the depth. The length of a gripping member being measured from fillet 64 to adjacent fillet 64. This length of each gripping member 44 is also the pitch for that gripping member 44 by definition. The depth of each fillet 64 is chosen to correspond to a certain pitch to depth ratio that has been found to be effective in producing the wrench jaw face that grips in the desired manner as applicant's invention discloses in this specification and claims. The pitch or horizontal length between the fillets 64 is determined by the flat 47 dimension of the smallest nut 45 to be driven by the jaw faces 22, 26 in a plane to plane manner. Wrench 10 is designed for a range of larger nuts 45 that have a larger pitch than those designed for a range of smaller nuts 45. In a typical embodiment, the pitch for a gripping member 44 may be 0.1750 or 0.20 inches, the corresponding depths of fillets 64 are 0.014 and 0.016 inches. The pitch to depth ratio is generally designed between 7:1 and 20:1.

In use, opening 20 of adjustable wrench 10 is placed about a nut 45. Worm gear 38 is rotated, which causes threads 42 to act on notches 32 formed on barrel 30 of movable member 18. Movable member 18 is then selectively positioned to engage nut 45. When "pushing" the wrench 10 or rotating the wrench 10 in a clock-wise direction (FIG. 1), corners A and D of nut 45 are engaged by drive surfaces 66, 68 on gripping members 44 located on stationary jaw drive face 22 and drive surfaces 76, 78 on gripping members 44 of movable jaw drive face 26. Nut 45 may be positioned between any of gripping members 44 located over the length of jaw drive faces 22 and 26.

Similarly, when "pulling" the wrench 10, or rotating the wrench 10 in a counter-clockwise direction (FIG. 4), corners C and F of nut 45 are engaged by drive surfaces 66, 68 on gripping members 44 located on stationary jaw drive face 22 and drive surfaces 76, 78 on gripping members 44 of movable jaw drive face 26.

Figure 15:
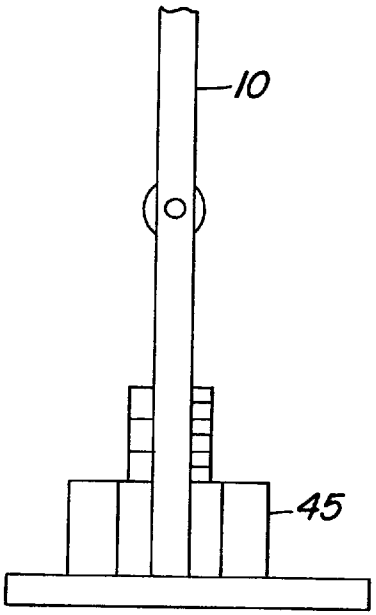
FIG. 15 shows an adjustable wrench engaging a nut in an overhead approach.
Figure 13:
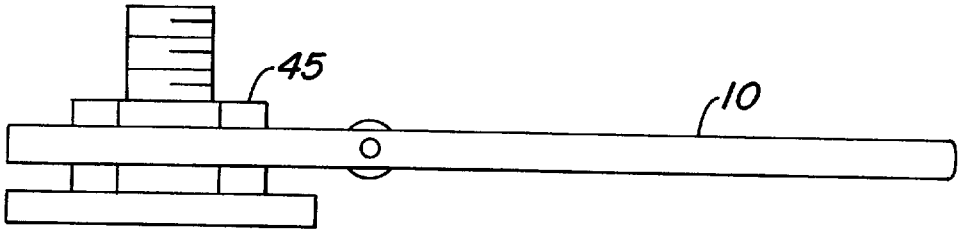
FIG. 13 shows an adjustable wrench engaging a nut in a flat approach which is perpendicular to the nut threading direction.
Figure 14:
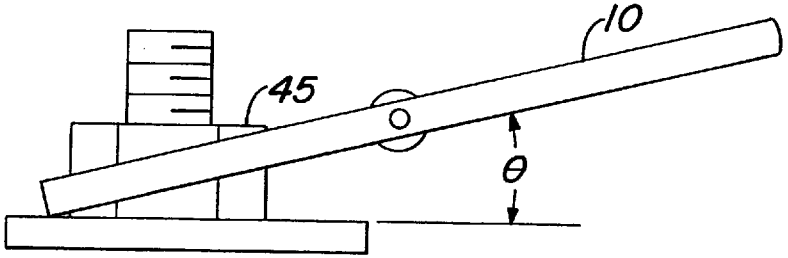
FIG. 14 shows an adjustable wrench engaging a nut in a higher angle approach.

Due to obstructions or other reasons, it may be difficult to fully insert nut 45 within opening 20 during use of adjustable wrench 10. Gripping members 44 enable nut 45 to be driven by the nose 17, 19 of stationary member 16 or movable member 18. Referring now to FIG. 5, nut 45 is shown engaged by gripping members 44 on stationary jaw drive face 22 on member 18. The movable jaw drive surface 26 on gripping member 44 is located near nut comer D. The flat 47 between corners C and D is engaged by nose 19 on movable member 18. The drive surface 26 on gripping member 44 located on stationary jaw drive face 22 prevents corner A from slipping over stationary jaw drive face 22 and facilitates driving of nut 45 by wrench 10. Additionally, the ability to drive the nut 45 from a nose position, as shown in FIG. 5, enables the user to rapidly engage and disengage the nut 45 with wrench 10, thereby enabling the user to manipulate the nut 45 quickly and easily. Because gripping members 44 drive on the nut planes, the nut corners tend to seat within fillets 64 and avoid the rounding problems associated with standard wrench jaw faces. A nut or bolt can be driven either in a flat approach where the wrench is generally perpendicular to the nut threading direction, as is shown in FIG. 13 or a high angle approach where the wrench is elevated with respect to a plane perpendicular to the threading direction of the nut by an angle Θ as is shown in FIG. 14. The wrench will also drive the nut in both directions from a directly overhead approach as is shown in FIG. 15.

The invention has numerous advantages. Providing gripping members on the drive surfaces of either the stationary or movable jaw drive face is beneficial for more effectively gripping nut planes. The wrench utilizes arched gripping members to increase the ability of an adjustable wrench to drive nuts of all sizes. The gripping members lock on nut under torque when driving the nut in either direction. The gripping members may be arranged such that the largest plane of the gripping member engages a nut when force is applied with a wrench in the "pulled" direction. The gripping members allow for a high angle of approach. The gripping members enable nut driving when the movable member is either tightly or loosely engaging the nut. When the wrench is adjusted to a loose nut to jaw configuration, any size nut that fits within the jaws will be driven in a plane to plane manner as opposed to a standard wrench that drives in a plane of wrench to nut comer point contact and additionally will be locked within the wrench jaws while applying torque in either direction. Further, the loose jaw configuration makes the wrench easy to put on and easy to take off of the nut or fastener from one power stroke to the next without adjusting the space between the jaws between strokes. The result is a much faster action than the standard flat jaw adjustable wrench.

Additionally, the plurality of gripping surfaces guarantees driving on the nut planes, not the nut corners, even when the jaws are tight against the nut.

While the invention has been shown in only one of its forms, it should be apparent to those skilled in the art that it is not so limited, but is susceptible to various changes without departing from the scope of the invention.

What is claimed is:

1. An adjustable wrench comprising:

a handle having a stationary member and a movable member, the movable member being adjustable attached to the handle; and wherein the stationary member has a jaw section comprising at least two gripping members, each of the gripping members having at least one convex curved surface for gripping a nut;

the movable member has a jaw section comprising at least two gripping members, each of the movable member gripping members having at least one convex curved surface for gripping a nut;

each of the gripping members changes progressively in length from a forward end of each of the jaw sections to a rearward end of each the jaw sections; and each of the gripping members increases progressively in length from the forward end of each of the jaw sections to a rearward end of each of the jaw sections.

2. An adjustable wrench comprising:

a handle having a stationary member and a movable member, the movable member being adjustably attached to the handle; and wherein the stationary member has a jaw section comprising at least two gripping members, each of the gripping members having at least one convex curved surface for gripping a nut;

the movable member has a jaw section comprising at least two gripping members, each of the movable member gripping members having at least one convex curved surface for gripping a nut;

each of the gripping members changes progressively in length from a forward end of each of the jaw sections to a rearward end of each the jaw sections; and each of the gripping members decreases progressively in length from the forward end of each of the jaw sections to a rearward end of each of the jaw sections.

3. An adjustable wrench comprising:

a handle having a stationary member and a movable member, the movable member being adjustably attached to the handle; and wherein the stationary member has a jaw section comprising at least two gripping members, each of the gripping members having at least one convex curved surface for gripping a nut;

the movable member has a jaw section comprising at least two gripping members, each of the gripping members having at least one convex curved surface for gripping a nut;

each of the gripping members changes progressively in length from a forward end of each of the jaw sections to a rearward end of each the jaw sections; and each of the gripping members has three different radii of curvatures, with one of the radii being on a forward portion, another on a central portion, and a third on a rearward portion of each of the gripping members.

4. The adjustable wrench as claimed in claim 3 wherein a horizontal length measured along a nose plane of the forward portion is substantially smaller than a horizontal length measured along a nose plane of the rearward portion.

5. An adjustable wrench comprising:

a handle having a stationary member and a movable member, the movable member being adjustably attached to the handle; and wherein the stationary member has a jaw section comprising at least two gripping members, each of the gripping members having at least one convex curved surface for gripping a nut;

the movable member has a jaw section comprising at least two gripping members, each of the movable member gripping members having at least one convex curved surface for gripping a nut;

each of the gripping members changes progressively in length from a forward end of each of the jaw sections to a rearward end of each the jaw sections; and each of the gripping members has a pitch between 0.1750 inches and 0.20 inches, and the adjustable wrench further comprises fillets corresponding to each of the gripping members, the fillets having depths ranging from 0.014 inches to 0.016 inches.

6. An adjustable wrench comprising:

a handle having a stationary member and a movable member, the movable member being adjustably attached to the handle; and wherein the stationary member has a jaw section comprising at least two gripping members, each of the gripping members having at least one convex curved surface for gripping a nut;

the movable member has a jaw section comprising at least two gripping members, each of the movable member gripping members having at least one convex curved surface for gripping a nut;

each of the gripping members changes progressively in length from a forward end of each of the jaw sections to a rearward end of each the jaw sections;

each of the gripping members has a pitch between 0.1750 inches and 0.20 inches, and the adjustable wrench further comprises fillets corresponding to each of the gripping members, the fillets having depths ranging from 0.014 inches to 0.016 inches; and the ratio of the pitch of any one of the gripping members to the depth of the corresponding fillet ranges from 7:1 to 20:1.

* * * * *